US005242010A

United States Patent [19]

Pleschiutschnigg et al.

[11] Patent Number: 5,242,010

[45] Date of Patent: Sep. 7, 1993

[54] METHOD FOR CONTROLLING THE TAPER OF NARROW FACES OF A LIQUID-COOLED MOLD

[75] Inventors: Fritz-Peter Pleschiutschnigg, Duisburg; Lothar Parschat, Ratingen; Uwe Franzen, Duisburg, all of Fed. Rep. of Germany

[73] Assignee: Mannesmann Aktiengesellschaft, Dusseldorf, Fed. Rep. of Germany

[21] Appl. No.: 887,741

[22] Filed: May 22, 1992

[30] Foreign Application Priority Data

May 22, 1991 [DE] Fed. Rep. of Germany ..... 4117073

[51] Int. Cl.[5] ..... B22D 11/16

[52] U.S. Cl. ..... 164/452; 164/491

[58] Field of Search ..... 164/452, 491, 154, 436

[56] References Cited

U.S. PATENT DOCUMENTS

| | | | |
|---|---|---|---|
| 3,838,730 | 10/1974 | Nagaoka et al. | 164/452 X |
| 3,926,244 | 12/1975 | Meier et al. | 164/491 X |
| 4,304,290 | 12/1981 | Wolf | 164/452 |
| 4,553,604 | 11/1985 | Yaji et al. | 164/491 X |

FOREIGN PATENT DOCUMENTS

| | | | |
|---|---|---|---|
| 2541606 | 8/1984 | France | 164/491 |
| 2645460 | 10/1990 | France | 164/491 |
| 62-13250 | 1/1987 | Japan | 164/452 |
| 1006049 | 3/1983 | U.S.S.R. | 164/452 |
| 1320010 | 6/1987 | U.S.S.R. | 164/452 |

*Primary Examiner*—J. Reed Batten, Jr.

*Attorney, Agent, or Firm*—Cohen, Pontani, Lieberman, Pavane

[57] ABSTRACT

The taper of narrow faces of a plate-type mold is controlled for the production of steel castings in slab form, wherein the plates of the mold are cooled by a liquid coolant and wherein the narrow faces can be adjusted between wide faces of the mold. Initially, the temperature of the coolant is measured at a coolant outlet of each plate of the mold. A cooling surface-related specific temperature value is then formed from each measured temperature. The specific temperature values of opposite plates are compared. The specific temperature values of each plate are compared with the specific temperature values of the adjoining plates. When a difference between the specific temperature values occurs, an adjustment value having a magnitude of the difference in values is applied to a drive of the narrow face which provides the lower temperature value, such that the taper of the narrow face is increased.

4 Claims, 2 Drawing Sheets

METHOD FOR CONTROLLING THE TAPER OF NARROW FACES OF A LIQUID-COOLED MOLD

BACKGROUND OF THE INVENTION

1. Field of the Invention

The present invention relates to a method and a device for producing steel castings in slab form. Specifically, the present invention relates to a method for controlling the taper of narrow faces of a liquid-cooled plate-type mold for the production of steel castings, wherein the narrow faces can be adjusted between wide faces.

2. Description of the Related Art

In the continuous casting of steel in liquid-cooled molds formed of individual plates for the production of castings in slab form, there is originally formed in the mold, due to the low thermal conductivity of the steel, only a thin casting shell of solidified melt. It is known and desired by the continuous caster that the casting shell is produced in the mold as far as possible in a thickness which is uniform over its circumference, since this thin casting shell must withstand, outside the mold, the ferrostatic pressure of the melt which is present within it. The person skilled in the art furthermore knows that the development of the thickness and of the uniformity of the solidified casting shell at the exit from the mold is dependent on a number of factors such as the casting rate, temperature of the steel, geometry, material and taper of the mold and, last but not least, the type and composition of the lubricant which is applied to the liquid-steel level or the meniscus and is to reduce the friction between casting shell and mold.

The fact that time and again casting breakouts occur, i.e. the melt emerges through the casting shell, which leads to an interruption in the casting, shows that this problem has not yet been reliably overcome, although there are any number of suggestions as to how to solve this problem.

Thus, proposals are known from DE 31 10 012 C1, EP 0 114 293 B1, DE 33 09 885 A1, DE 39 08 328 A1 which attempt, by adjustment of the taper of the narrow faces of the mold, to determine or influence the cooling conditions in the mold and thus the formation of the casting shell.

On the other hand, it is known from DE-OS 15 08 966, DAS 23 19 323, DE-PS 23 20 277, DE-PS 24 40 273, and DE 34 23 475 C2 to control the thickness of the casting shell by measurements of the temperature of the mold wall or of the quantity of heat discharged from the mold.

All known methods have in common that the mold, or the entire plant, is controlled on the basis of measured values compared with predetermined desired values, it remaining open, however, to what extent the predetermined desired values take into account the actual circumstances or requirements.

SUMMARY OF THE INVENTION

Therefore, it is the object of the present invention to overcome the above-described problems in a liquid-cooled plate mold for the production of steel castings in slab form having narrow-face plates which can be adjusted between wide-face plates.

In accordance with the present invention, the temperature of the coolant is measured at the coolant outlet of the plates for each of the liquid-cooled plates of the mold. A cooling surface-related specific temperature value is formed from each measured temperature. The specific temperature values of opposite plates are compared. In addition, the temperature value of each plate is compared with the specific temperature values of the adjoining plates. When a difference between the temperature values occurs, an adjustment value in a magnitude of the difference value is applied to the drive of that narrow face of the mold which supplies the lower temperature value, in order to increase the taper thereof.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there is illustrated and described a preferred embodiment of the invention.

DESCRIPTION OF THE PREFERRED EMBODIMENT

Figure 1:
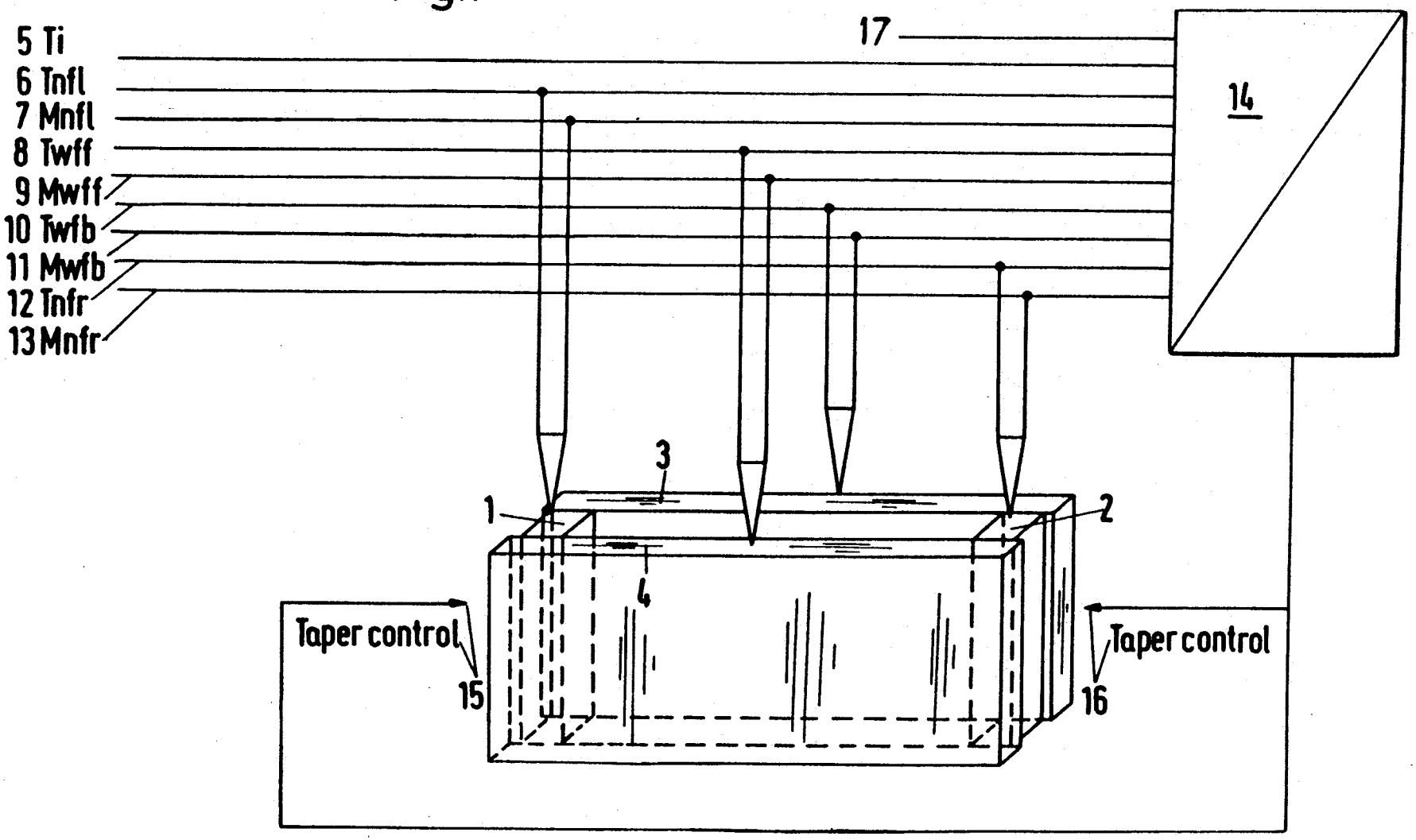
FIG. 1 schematically illustrates a mold for the production of castings in slab form.

FIG. 1 schematically shows a mold for the production of castings in slab form. The mold includes wide face plates 3, 4, and, arranged adjustably therebetween, narrow-face plates 1, 2. All four sides are water-cooled in the conventional manner, i.e. they are each provided with a water inlet and a water outlet and the narrow faces are provided with means for establishing different casting widths and for adjusting the taper. Since these features are known to the person skilled in the art, they are not shown in detail in the drawing.

The water inlet temperature 5 is determined for each of the four plates of the mold. As a rule, the temperature is the same for all four plates, so that one measurement value is sufficient. After passage of the water through the mold, the temperature of the water is determined for each of the narrow-face and wide-face plates 1, 2, 3, 4 as close as possible to the place of connection of the water outlet to the mold plate. Also measured is the quantity of water fed to each plate (reference Nos. 6 to 13).

In this connection, reference number

6—Tnfl is the water outlet temperature—left narrow-face plate;

7—Mnfl is the water quantity—left narrow-face plate;

8—Twff is the water outlet temperature—front wide-face plate;

9—Mwff is the water quantity—front wide-face plate;

10—Twfb is the water outlet temperature—rear wide-face plate;

11—Mwfb is the water quantity—rear wide-face plate;

12—Tnfr is the water outlet temperature—right narrow-face plate; and

13—Mnfr is the water quantity—right narrow-face plate.

These measured values are fed to a computer 14 in which given desired values 17 (operator input) representing an optimum mold configuration have been entered. Based on the comparison of the measured values with the desired values, when differences in the values occur, the computer provides corresponding setting signals to the drive of the narrow-face plate adjusting devices 15, 16.

Figure 2:
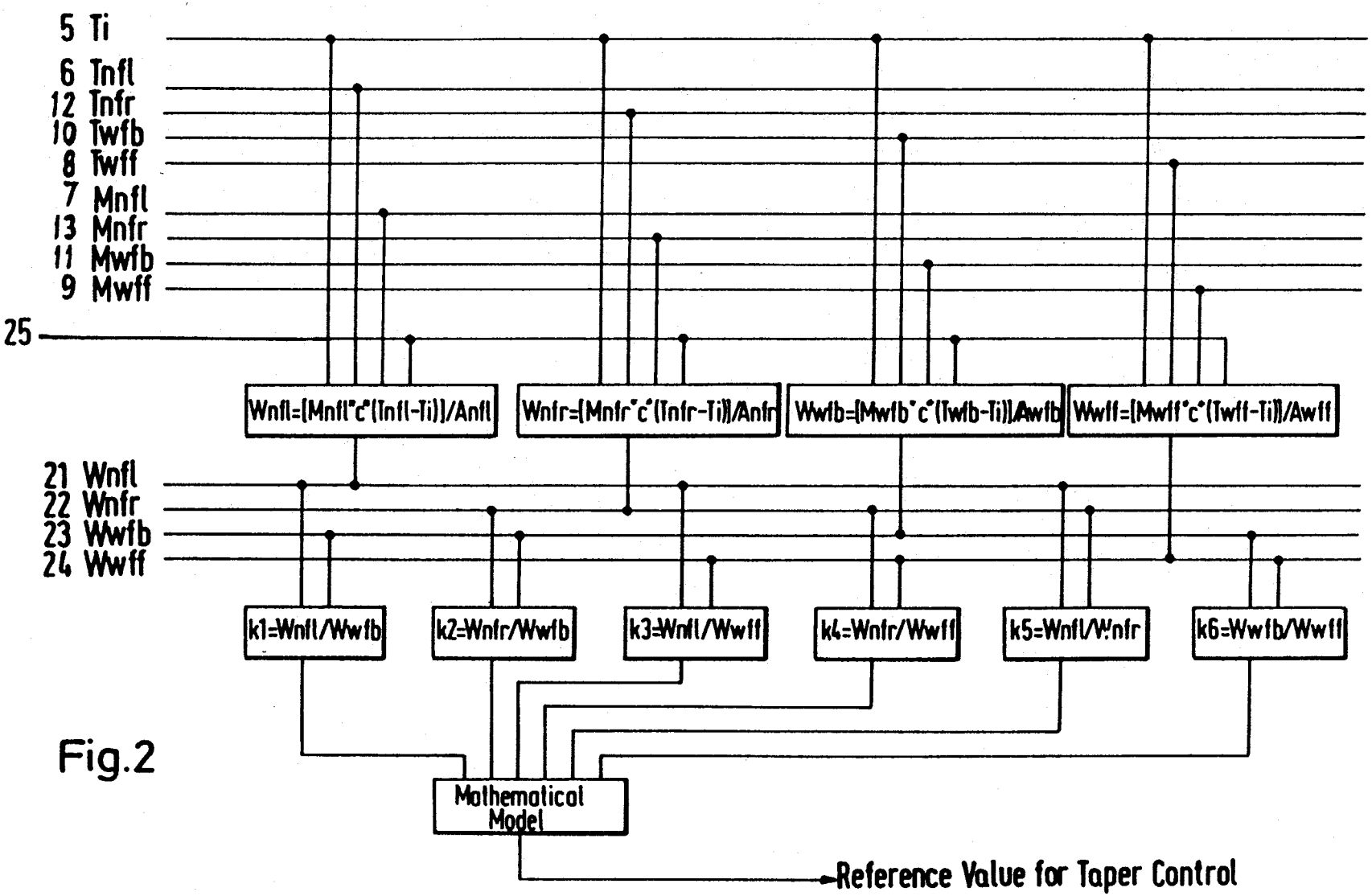
FIG. 2 is a diagram illustrating the processing program of a computer used in operating the mold.

FIG. 2 shows diagrammatically the processing program of the computer 14. The quantities of heat 21, 22, 23, 24 which have been removed from each mold plate are determined from the measured values 5 to 13 detected. In FIG. 2, the reference numbers have the following meaning:

21—Wnfl—heat quantity of the left narrow-face plate 1;

22—Wnfr—heat quantity of the right narrow-face plate 2;

23—Wwfb—heat quantity of the rear wide-face plate 3; and

24—Wwff—heat quantity of the front wide-face plate 4.

Since the mold size 25 is also entered, the specific thermal load (specific temperature) can be determined for each mold plate 1 to 4.

In a further step, the specific temperature values for each wide-face plate are now related to those of the adjoining narrow-face plates, so that the following values result;

K1—from the ratio of narrow-face plate 3 to wide-face plate 1;

K2—from the ratio of narrow-face plate 3 to wide-face plate 2;

K3—from the ratio of narrow-face plate 4 to wide-face plate 1; and

K4—from the ratio of narrow-face plate 4 to wide-face plate 2.

Furthermore, by comparing with each other the quantities of heat which have been removed from the narrow-face plates 1, 2 resulting in ratio K5 and from the wide-face plates 3, 4 resulting in ratio K6, conclusions can be drawn as to the thickness of the shell of the casting in the mold and be used for correcting the taper setting of the narrow-face plates. Also in this case, the narrow face which supplies the lower temperature value will be adjusted such that the taper is increased.

If the values K1 to K6 are evaluated at time intervals, or recorded continuously, an ideal state which defines a uniform shell thickness of the casting in the mold always results in a certain relationship of the values K1 to K6 to each other or a certain curve. The specific temperature values representing the specific temperature values over time can be recorded in the form of curves. The curves over time can be examined with respect to parallelity in a computer. Deviations of a curve from the other parallel curves can be applied as an adjusting value having a magnitude of the deviation to the corresponding drive of the narrow face plate until all curves are again parallel. If one or more values differ by more than a given amount from the other values obtained at the same time, this is an indication of a disturbance in the heat transfer and thus of a change in the formation of the casting shell in a corresponding region of the mold, which at the same time provides an early warning that a casting breakout is to be expected. This danger can therefore be counteracted at an early time by correcting the taper of the mold, or by changing the casting rate, by changing the oscillation parameters, or by changing the composition of the casting flux.

It should be understood that the preferred embodiments and examples described are for illustrative purposes only and are not to be construed as limiting the scope of the present invention which is properly delineated only in the appended claims.

We claim:

1. A method for controlling the taper of narrow faces of a plate-type mold for the production of steel castings in slab form, wherein the plates of the mold are cooled by means of a liquid coolant, and wherein the narrow faces are adjustable between wide faces, the method comprising:

initially measuring the temperature of the coolant at a coolant outlet of each plate, forming a cooling surface-related specific temperature value from each measured temperature, comparing the specific temperature values of opposite plates, comparing the temperature values of each plate with the specific temperature values of adjoining plates, and in the event of a difference between the temperature values, applying an adjustment value having a magnitude of the value of the difference to a drive of one of the narrow faces which provides a lower temperature value, such that the taper of the narrow face which provides the lower temperature value is increased.

2. The method according to claim 1, comprising continuously measuring the temperature of the coolant.

3. The method according to claim 1, comprising determining as the temperature value of each plate, the quantity of heat removed in relation to a unit of area.

4. The method according to claim 1, comprising continuously determining the specific temperature values representing the specific temperature values over time in the form of curves, examining the curves over time with respect to parallelity in a computer, and applying deviations of a curve from the other parallel curves as an adjusting value having a magnitude of the deviation to the corresponding drive of the narrow face plate until all curves are again parallel.

* * * * *